US007043946B2

(12) United States Patent
Cline

(10) Patent No.: US 7,043,946 B2
(45) Date of Patent: May 16, 2006

(54) DISGUISED SAFE

(76) Inventor: Gayle M. Cline, 1196 N. Garrison, Carthage, MO (US) 64836

( * ) Notice: Subject to any disclaimer, the term of this patent is extended or adjusted under 35 U.S.C. 154(b) by 0 days.

(21) Appl. No.: 10/746,015

(22) Filed: Dec. 24, 2003

(65) Prior Publication Data

US 2005/0138975 A1 Jun. 30, 2005

(51) Int. Cl.
*B65D 55/14* (2006.01)

(52) U.S. Cl. ..... 70/63; 109/45; 109/50; 109/54; 206/457

(58) Field of Classification Search ..... 109/45, 109/50–54; 70/63; 206/882, 457, 458
See application file for complete search history.

(56) References Cited

U.S. PATENT DOCUMENTS

| | | | | | |
|---|---|---|---|---|---|
| 968,536 | A | * | 8/1910 | Brucklacher | 109/50 |
| 1,546,884 | A | * | 7/1925 | Burnett | 109/50 |
| 2,819,692 | A | * | 1/1958 | Jonhnson et al. | 109/50 |
| 3,762,789 | A | | 10/1973 | Robertson | |
| 3,848,940 | A | | 11/1974 | Berens | |
| 3,999,493 | A | * | 12/1976 | Gulya | 109/23 |
| 4,040,365 | A | * | 8/1977 | Baxter | 109/50 |
| 4,043,279 | A | | 8/1977 | Padgett | |
| 4,083,314 | A | * | 4/1978 | Garvin | 109/50 |
| 4,089,446 | A | * | 5/1978 | Logan et al. | 222/609 |
| 4,099,808 | A | | 7/1978 | Oakley et al. | |
| 4,116,357 | A | * | 9/1978 | Stanley, Jr. | 220/203.03 |
| 4,155,608 | A | | 5/1979 | Orlewicz | |
| 4,172,424 | A | | 10/1979 | de Palau | |
| 4,252,387 | A | | 2/1981 | Wagner | |
| 4,304,447 | A | | 12/1981 | Ellwood et al. | |
| 4,419,939 | A | | 12/1983 | Reverte | |
| 4,480,173 | A | * | 10/1984 | Butterfield | 392/401 |
| 4,531,635 | A | * | 7/1985 | Cleveland | 206/457 |
| 4,821,652 | A | * | 4/1989 | Hoffman | 109/23 |
| 4,925,255 | A | | 5/1990 | DeBlaay | |
| 4,936,038 | A | | 6/1990 | Johnson et al. | |
| 4,951,577 | A | | 8/1990 | Bentley | |
| 5,005,336 | A | * | 4/1991 | Bloom | 53/401 |
| D343,970 | S | | 2/1994 | Campbell | |
| 5,346,066 | A | * | 9/1994 | Jones | 206/457 |
| 5,372,076 | A | * | 12/1994 | Solt | 109/22 |
| 5,511,711 | A | | 4/1996 | Kunz | |
| 5,586,934 | A | | 12/1996 | Dombrowski et al. | |
| 5,772,295 | A | | 6/1998 | Sundmark | |
| 5,810,213 | A | * | 9/1998 | Flores et al. | 222/610 |
| 5,944,396 | A | | 8/1999 | Stephan | |

(Continued)

OTHER PUBLICATIONS

Security and Legal Considerations, Feb. 16, 2001, www.savvy survior.com website, pp. 1-11, especially p. 9.*

(Continued)

*Primary Examiner*—Suzanne Dino Barrett
(74) *Attorney, Agent, or Firm*—Martin & Associates, L.L.C.; Derek P. Martin

(57) ABSTRACT

A safe for storing valuables such as guns has an external configuration that resembles a water processing apparatus such as a water heater, water softener, or pressure tank. The safe includes a door that provides access to a dry cavity within the safe for storing valuables. A lock mechanism securely locks the door shut to secure the valuables within the safe. The safe of the preferred embodiments is concealed to look like a water processing apparatus, and includes a lock to deter a thief that happens to discover the safe.

8 Claims, 5 Drawing Sheets

U.S. PATENT DOCUMENTS 6,059,388 A 5/2000 Wheatley, Jr.
D440,287 S * 4/2001 Jackson et al. ..... D23/322
6,292,960 B1 * 9/2001 Bowling ..... 5/308
6,308,009 B1 * 10/2001 Shellenberger et al. ..... 392/454
6,400,269 B1 6/2002 Savastano
6,449,789 B1 * 9/2002 Krass et al. ..... 7/143
6,508,208 B1 * 1/2003 Frasure et al. ..... 122/388
D483,453 S * 12/2003 Yamamoto et al. ..... D23/320
6,684,432 B1 * 2/2004 Owens, Jr. ..... 5/694

OTHER PUBLICATIONS

Hiding Tangible Wealth, Dec. 31, 1998, hollyd#netconnect.com, pp. 1-3, p. 2 especially.*

* cited by examiner

DISGUISED SAFE

BACKGROUND OF THE INVENTION

1. Technical Field

This invention generally relates to the storing of valuables, and more specifically relates to the storage of valuables in a safe that is disguised to look like a water processing apparatus such as a water heater, water softener, or pressure tank.

2. Background Art

Since the beginning of time, mankind has developed numerous devices and methods for securing valuables from theft. One common device for securing valuables is a safe. Most known safes have a key lock or combination lock on a door that provides access to an interior cavity that may be used to store valuables.

One problem with safes is the lock mechanism may easily be defeated by a skilled thief. In fact, skilled thieves can usually defeat a combination lock on most home safes by drilling in as little as twenty minutes or less. For these thieves, the valuables in a safe may be stolen by searching for a safe, and once located, by defeating the safe's locking mechanism, to access its valuable contents.

Another known way to protect valuables from thieves is to disguise the valuables so they are not readily recognizable as valuables to a thief. For example, one known device has the appearance of an unopened can of soda pop. The device has a threaded bottom that, once removed, allows placing valuables (such as jewelry) within the can. The threaded bottom may then be replaced, and the can may then be stored in the pantry or refrigerator. The valuables are secure in such a disguised container in two ways. First, a thief will generally not search a pantry or refrigerator for valuables. Second, even if the thief searches the pantry or refrigerator, the thief will generally not recognize the can as a container for concealing valuables because it looks like a traditional soda pop can. Note, however, that if the thief manages to locate the disguised container, he or she may easily access the valuable contents because the disguised container contains no lock mechanism. Even if the soda can disguised container were to include a lock mechanism, the entire container with its contents could be easily carried off and thus stolen by a thief. What is needed is a device for storing valuables that is disguised, that may be securely locked, and that is sufficiently large and/or heavy that it cannot be easily lifted and transported off-site by a thief.

DISCLOSURE OF INVENTION

According to the preferred embodiments, a safe for storing valuables such as guns has an external configuration that resembles a water processing apparatus such as a water heater, water softener, or pressure tank. The safe includes a door that provides access to a dry cavity within the safe for storing valuables. A lock mechanism securely locks the door shut to secure the valuables within the safe. The safe of the preferred embodiments is concealed to look like a water processing apparatus, and includes a lock to deter a thief that happens to discover the safe.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and.

BEST MODE FOR CARRYING OUT THE INVENTION

The preferred embodiments provide a safe that has the external appearance of a water processing apparatus, such as a water heater, water softener, or pressure tank. The safe includes one or more plumbing fittings or plumbing devices that substantially conceal a lock actuator. In a first embodiment, a single enclosure has a concealed lock mechanism. In a second embodiment, a first enclosure is located within a second enclosure. Either or both of the two enclosures in the second embodiment may have a corresponding lock mechanism. The safe of the preferred embodiments provides security for its contents in at least two ways. The first way is the disguising of the safe as a water processing apparatus. The second way is one or more lock mechanisms that prevent a thief from opening the safe even if the safe is discovered.

Figure 1:
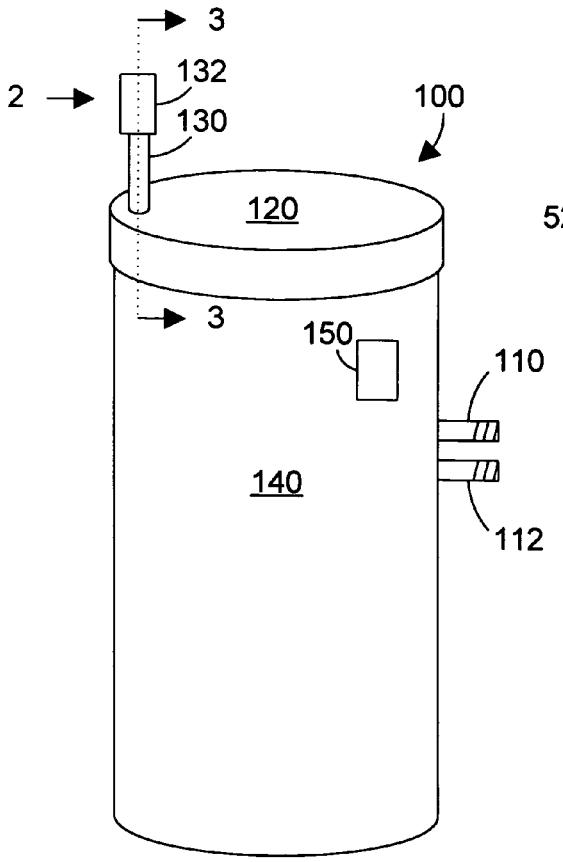
FIG. 1 is a side view of a disguised safe in accordance with a first embodiment.
Figure 2:
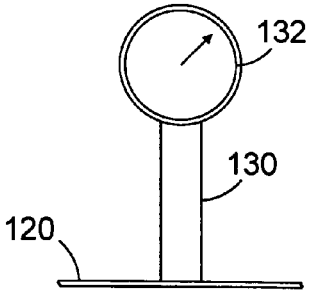
FIG. 2 is a front view 2 of the gauge in FIG. 1.

Referring to FIG. 1, a disguised safe 100 in accordance with the preferred embodiments has an external configuration that resembles a water heater. The safe 100 has a cylindrical shape with one or more plumbing fittings (i.e., pipes 110, 112) that may be attached to pipes to give the safe 100 the appearance of being an installed water heater. Note that the view in FIG. 1 is a side view that shows the pipes 110, 112 that may be run into a wall behind the safe 100. Safe 100 includes a removable cover 120 that covers a bottom portion 140. The lower end of a pipe 130 is attached to the cover, and a gauge 132 is attached to the upper end of the pipe 130. A front view of the pipe 130 and gauge 132 is shown at 2 in FIG. 1, the details of which are shown in FIG. 2.

Pipe 130 may be coupled to cover 120 in any suitable manner, including welding, threads, solder connection, etc. Gauge 132 is a dummy gauge that enhances the appearance of the safe 100 as a water heater. Gauge 132 may indicate water pressure, or in this particular case where safe 100 resembles a water heater, gauge 132 may indicate water temperature. Gauge 132 is a dummy gauge because it doesn't actually measure anything, it simply provides the appearance of a functioning gauge.

Figure 5:
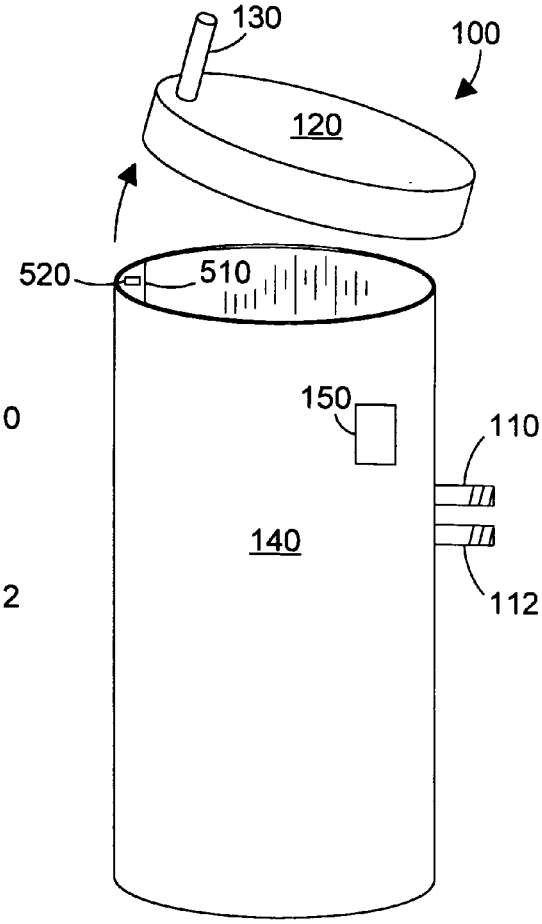
FIG. 5 is a side view of the safe of FIG. 1 showing the removal of the cover once the lock mechanism is in its unlocked position.
Figure 3:
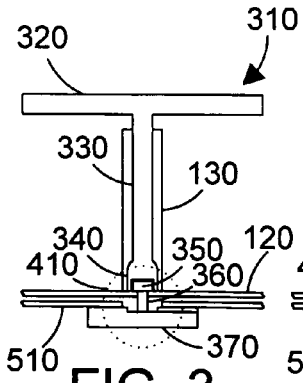
FIG. 3 is a cross-sectional view of the pipe 130 in FIG. 1 taken along the line 3—3 showing a lock mechanism in a locked position.
Figure 4:
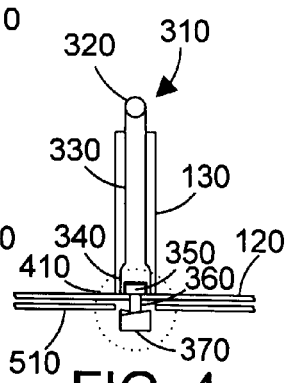
FIG. 4 is a cross-sectional view of the lock mechanism in FIG. 1 taken along the line 3—3 with the lock mechanism in an unlocked position.

A cross-sectional view of the apparatus along the line 3—3 in FIG. 1 is shown in FIG. 3. In the preferred embodiments, gauge 132 is threaded onto pipe 130 only hand-tight, which means a person can remove gauge 132 from pipe 130 without using any tools. Note, however, that it is equally within the scope of the preferred embodiments to tighten gauge 132 onto pipe 130 using a tool, which would then require a tool to remove the gauge 132 from pipe 130. Once the gauge 132 is removed from pipe 130, a specially-configured tool 310 may be inserted into pipe 130. Tool 310 includes a T-handle 320 coupled to a shaft 330 that has an end portion 340 that is configured to engage a lock actuator 350 within pipe 130. The lock actuator 350 in the specific configuration of FIGS. 1–5 preferably comprises a bolt head that rests atop the cover 120. The bolt head may have any suitable configuration, including flat slot for a screwdriver, Phillips head, hex head, hex key, torx head, square head, triangle head, pentagon head, etc. In addition, the bold head 350 may have a non-conventional shape or configuration that allows a corresponding unique tool to be used to rotate the bolt head 350. The bolt head 350 is attached to a shaft 360, which is coupled to an engagement device 370. The combination of the actuator 350, shaft 360, and engagement device 370 collectively comprise a lock mechanism 410 that is used to lock the cover 120 in place. Underneath cover 120 at the location of the lock mechanism 410 is a plate 510, shown best in FIG. 5, that is attached to the top edge of the bottom portion 140. Plate 510 includes a slot 520 through which the engagement device 370 passes when the lock mechanism 410 is in an unlocked position, and which engagement device engages when the lock mechanism 410 is in a locked position. In FIG. 3, lock mechanism 410 is shown in a locked position, with the engagement device 370 rotated within the slot to engage the plate 510 as shown. The tool 310 may be used to rotate the lock mechanism 410 a quarter turn from its locked position shown in FIG. 3 to its unlocked position shown in FIG. 4. In the unlocked position, the engagement device 370 aligns with the slot 520 in plate 510, allowing the engagement device 370 to pass through the slot 520 when the cover 120 is lifted off the base portion 140 as shown in FIG. 5. In the preferred embodiments, plate 510 includes stops (not shown) at the unlocked position and at the locked position that limit the rotation of the engagement device 370 one quarter turn between the locked position and the unlocked position. This provides tactile feedback to the user to know when the cover 120 is locked and when it is unlocked. Note also that engagement device 370 preferably includes beveled edges (as shown in FIG. 4) that cause the engagement device 370 to put increasing pressure on the plate 510 as the actuator 350 is rotated into the locked position. In this manner the lock mechanism 410 will have a friction fit that resists movement of the lock mechanism 410 until the tool 310 is used to turn the actuator 350 to the unlocked position.

Once the cover 120 is unlocked as shown in FIG. 4, the cover 120 is removed, as shown in FIG. 5, and the contents of the safe may be accessed. Note that a second locked lid could be included underneath the cover 120 that is locked into place using a padlock or other lock mechanism to provide additional security. The tall configuration of most known water heaters make the safe 140 especially well-suited to storing long guns such as rifles and shotguns. The safe 100 may thus be used as a gun safe that conceals the guns in a way that deters a thief from detecting their location, and that prevents the thief from opening the gun safe even if discovered, because opening the safe 100 requires the use of a specially-configured tool 310. One significant advantage of the safe 100 when used as a gun safe is that safe 100 may include an electrical box or fitting 150 through which an electrical cord or cable may be placed to provide power to an electric dehumidifier within the valuable storage cavity of safe 100. Storing guns in humid climates typically requires the use of an electric dehumidifier to prevent the guns from rusting. Providing a safe 100 that is disguised as an electric water heater means that an apparent electrical input 150 to the water heater may instead be used to provide power to an electric dehumidifier within the safe 100. In this manner, power may be connected to the safe 100 in a manner that is wholly consistent with its disguise of being an electric water heater.

Figure 6:
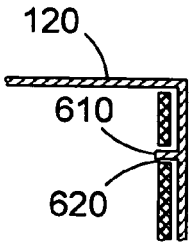
FIG. 6 is a cross-sectional view of an engaging tab that causes one portion of the lid to engage a portion of the apparatus in accordance with the preferred embodiments.
Figure 8:
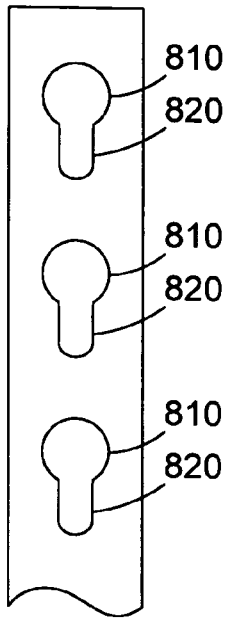
FIG. 8 is a partial front view of slots that engage the removable side cover of the apparatus in FIG. 7.

The lock mechanism in the cover 120 locks one edge of the cover in place. Of course, a second pipe and corresponding lock mechanism could be provided on the opposite side of the cover to lock two opposing sides of the cover in place. However, in the preferred embodiments, a lock mechanism is used on one side of the cover, and one or more retaining tabs are used on the opposite side of the cover, as shown in FIG. 6. Cover 120 includes one or more retaining tabs 610 that pass through a corresponding slot 620 when the cover 120 is placed atop the bottom portion 140. The retaining tab 610 may have any suitable configuration, such as one or more circular pins, but in the preferred embodiments the retaining tab 610 is a rectangular tab. The slot 620 may also have any suitable configuration, but in the preferred embodiments the slot 620 is slightly larger than the retaining tab 610, allowing the retaining tab 610 to be placed within the slot 620 when the cover 120 is placed atop the bottom portion 140.

The use of the retaining tab 610 and slot 620 shown in FIG. 2 requires a specific sequence to remove and install cover 120. When removing cover 120, the gauge 132 in FIG. 2 is removed, the tool 310 is placed within the pipe 130 to engage the actuator head 350, and the actuator head 350 is rotated a quarter turn from its locked position in FIG. 3 to its unlocked position in FIG. 4. Once in the unlocked position, the engagement device 370 is aligned with the slot 520 in plate 510, which allows the left side of the cover 120 in FIG. 1 to be pivoted away from the bottom portion 140. At this point, however, the engagement tab 610 is still within the engagement slot 620. Once the cover 120 is pivoted to a position where its side wall is above the bottom portion 140, the cover 120 may be pushed in a rearward direction to push retaining tab 610 out of slot 620. In this manner, the cover 120 may be securely retained atop the bottom portion 140 using only a single lock mechanism. When the cover 120 needs to be replaced on the bottom portion 140, the cover 120 is first tilted as shown in FIG. 5, and the retaining tab 610 is placed within the slot 620 by aligning the two, then sliding the cover 120 forward. The cover 120 can only sit down in its proper location if the retaining tab 610 is within the slot 620. The cover 120 is slid forward until its front edge clears the bottom portion 140, which causes the engagement device 370 to pass through slot 520 in plate 510. At this point, the tool 310 may be used to rotate the actuator head 350 of the lock mechanism from the unlocked position shown in FIG. 4 to the locked position shown in FIG. 3.

Note that any suitable number and type and location of retaining tabs 610 and lock mechanism 410 may be used. For example, in the preferred implementation, one retaining tab 610 is provided directly across from (180 degrees) from the lock mechanism 410. In the alternative, two retaining tabs 610 could be located at 120 degree angles apart from the lock mechanism 410. Of course, the lock mechanism 410 could be attached to the bottom portion 140 instead of being attached to the cover 120. In addition, the lock mechanism 410 may be actuated in any suitable manner within the scope of the preferred embodiments. In FIGS. 3 and 4, the lock mechanism 410 is actuated by rotating the head 350 a quarter turn. However, lock mechanism 410 could instead have a push-button actuator or a slide actuator that require a special tool. The preferred embodiments extend to any and all lock mechanisms that may be unlocked using a corresponding tool.

Figure 9:
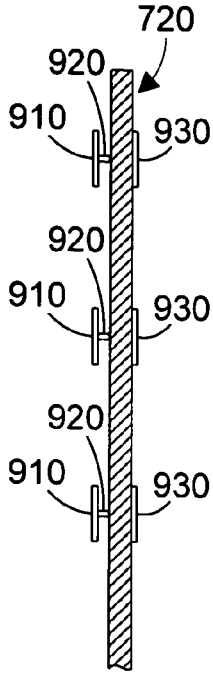
FIG. 9 is a side view of buttons on the side cover of the apparatus that engage the slots in FIG. 8 to lock the removable side cover in place.
Figure 7:
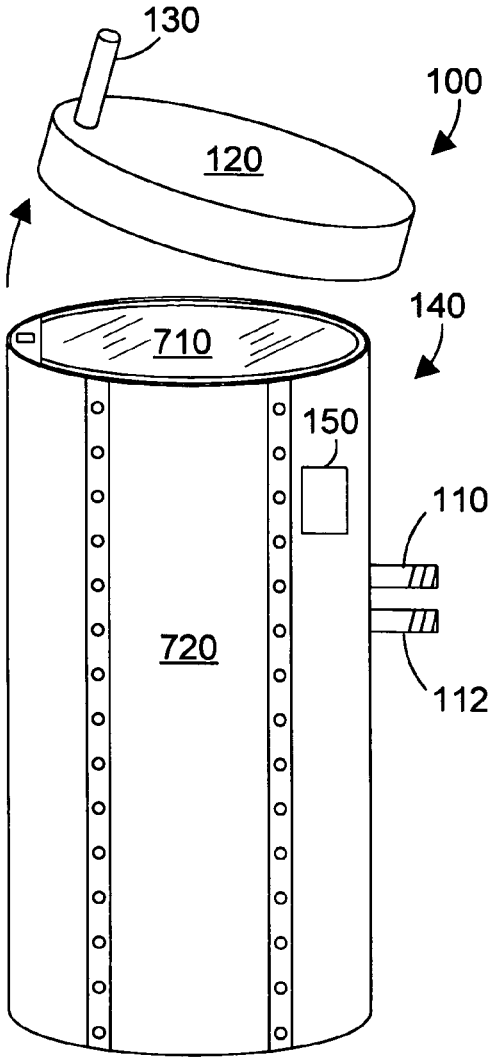
FIG. 7 is a side view of a disguised safe that includes an inner enclosure in accordance with a second embodiment.
Figure 10:
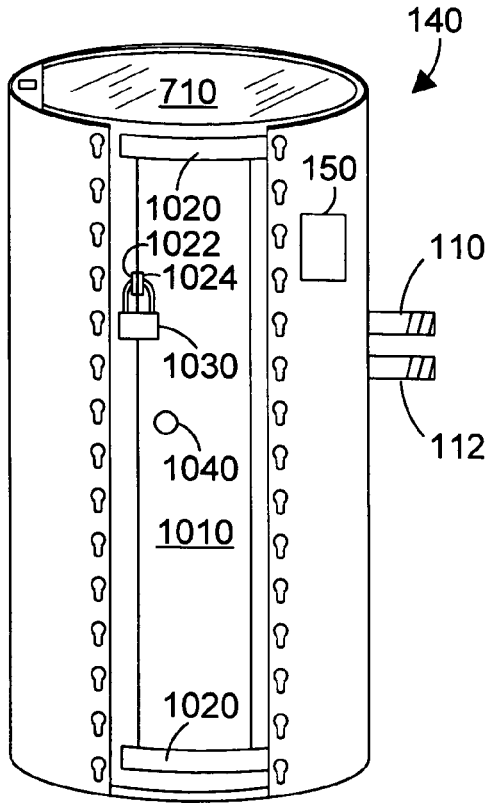
FIG. 10 is a side view of the apparatus in FIG. 7 with the side cover removed.

The safe shown in FIGS. 1–6 provides a single enclosure with a removable cover 120. In a second embodiment of the invention, the safe 100 includes two enclosures, one example of which is shown in FIGS. 7–10. As shown in FIG. 7, removing cover 120 reveals a second enclosure 710 within the bottom portion 140. The space between the first and second enclosures may include fireproofing material to better protect the contents of the safe from fire. Bottom portion 140 preferably includes a removable side cover 720. One suitable configuration for removable side cover 720 is shown in FIG. 9. Circular buttons 910 are attached to posts 920. Opposing buttons 930 create the external appearance of rivets, as shown in FIG. 7. Buttons 910 are sized to fit within a circular hole 810, shown in FIG. 8. Once all buttons 910 are within the corresponding circular holes 810, a downward force on the removable cover will push the posts 920 into the corresponding slots 820, with the buttons 910 opposite the slots. In this manner removable cover 720 may be easily attached to or removed from the bottom portion 140. As shown in FIG. 7, the removable side cover 720 is removed by providing an upward force on the removable side cover 720, which causes the buttons 910 to slide to align with the circular holes 810, at which point the removable side cover 720 may be removed. Note, however, that the upward motion that is required to remove the removable side cover 720 is only possible if the top cover 120 has been removed. As a result, the removable side cover 720 cannot be removed as long as the top cover 120 is in place.

The removal of removable cover 720 reveals a movable cover 1010 on the inner enclosure. In the specific configuration shown in FIG. 10, inner cover 1010 is a sliding cover that has a radius of curvature that matches the radius of curvature of the inner enclosure. Tracks 1020 are provided top and bottom that allow the inner cover 1010 to be slid rightward in FIG. 10. Note that inner cover 1010 includes a tab 1024 that aligns with a tab 1022 welded on the inner enclosure. When the inner cover 1010 is in its closed position (shown in FIG. 10), the two tabs align, allowing a padlock 1030 to be passed through the tabs, locking the inner cover 1010 in place. Note that tabs and padlock 1030 are shown as one suitable locking mechanism used to secure the inner cover 1010. Of course, any suitable lock mechanism could be used, including combination locks, key locks, or specially configured or concealed locks (like lock mechanism 410 shown in FIG. 4). By providing multiple levels of locks along with a disguise as a water processing apparatus, the safe 100 provides a more secure system for storing valuables.

Figure 11:
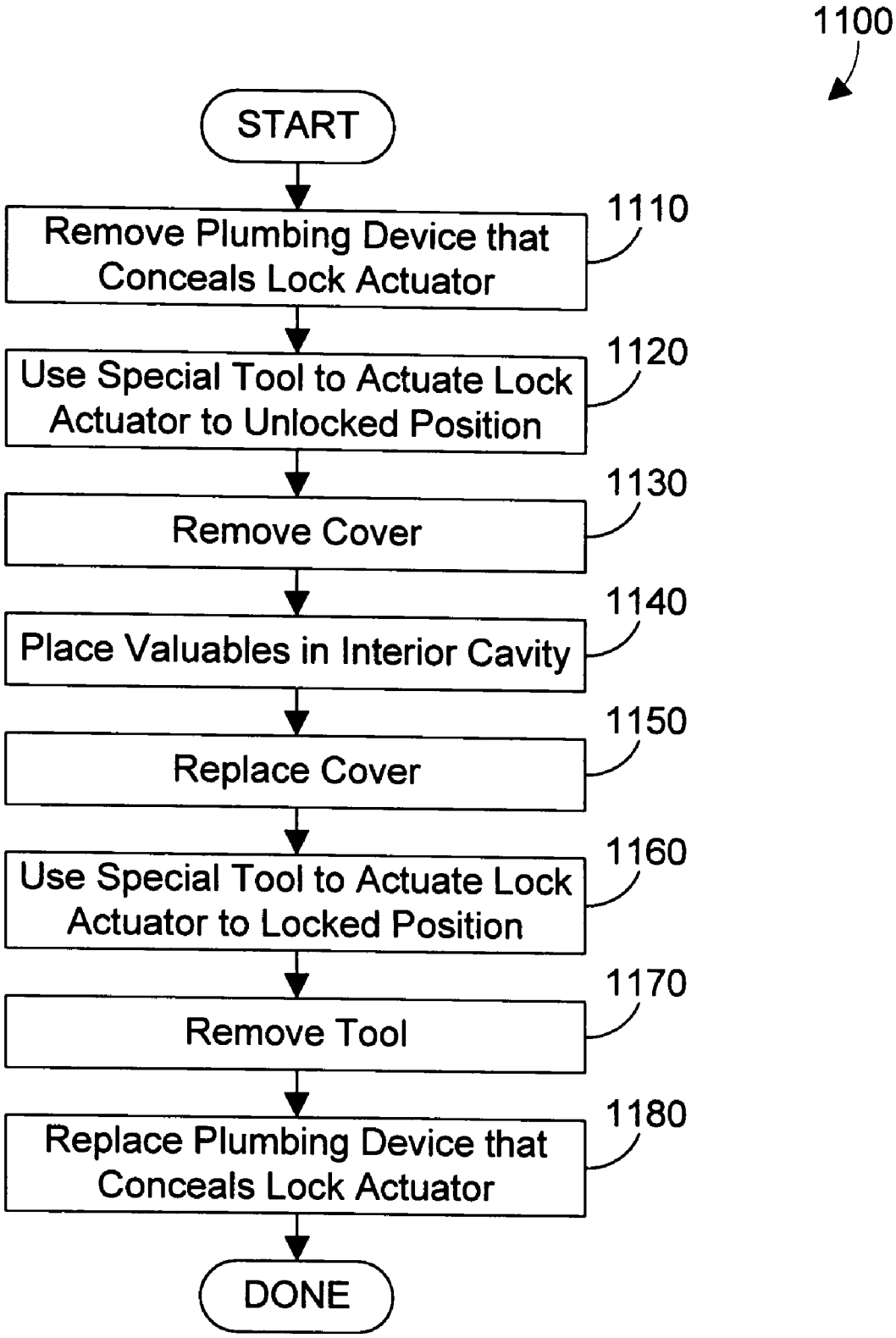
FIG. 11 is a flow diagram of a method in accordance with the preferred embodiments for storing valuables within the safe shown in FIGS. 1–6.

Referring to FIG. 11, a method 1100 in accordance with the preferred embodiments for storing valuables begins by removing the plumbing device that conceals the lock actuator (step 1110). In the specific examples shown in FIGS. 1, 2 and 12, the pipe 130 substantially conceals the lock actuator, and the gauge 132 completely conceals the lock actuator. Step 1110 in FIG. 11 would include the removal of the gauge in FIGS. 1, 2 and 12. At this point a special tool is used to actuate the lock actuator to its unlocked position (step 1120). One specific example of a tool is shown in FIGS. 3 and 4, which allow actuating the lock actuator by rotating the lock actuator one-quarter turn. The cover is then removed (step 1130). Valuables may now be placed within the valuable storage cavity (step 1140). The cover is replaced (step 1150), and the special tool is used to actuate the lock to its locked position (step 1160). The tool is then removed (step 1170), and the plumbing device (e.g., gauge 132) that conceals the lock actuator is replaced (step 1180). While method 1100 includes step 1110 that removes a plumbing device and step 1180 that replaces the plumbing device, these steps are not required in the broadest method in accordance with the preferred embodiments. The lock actuator may be mostly concealed, but viewable (such as within a pipe), in a manner that allows actuating the lock actuator without removing any plumbing fitting or plumbing device.

Figure 12:
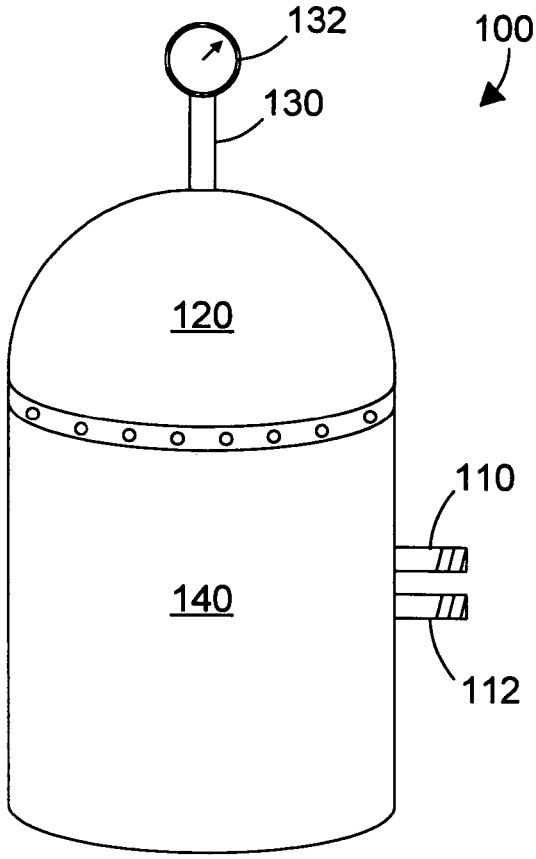
FIG. 12 is a side view of a pressure tank in accordance with the preferred embodiments.
Figure 13:
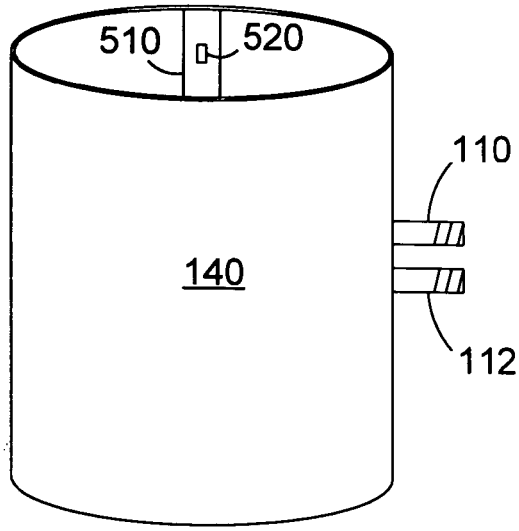
FIG. 13 is a side view of the pressure tank of FIG. 11 with the top removed.

Another suitable example of a water processing apparatus is a pressure tank. Homes that have their own wells typically have a pressure tank for regulating the water pressure from the well to a desired level. A safe 100 in accordance with the first embodiment that is configured to look like a pressure tank is shown in FIGS. 12 and 13. The cover 120 could be removed and locked into place using a lock mechanism similar to that shown in FIGS. 3 and 4 that engages a slot 520 in plate 510 shown in FIG. 13. In this configuration, gauge 132 would indicate pressure instead of temperature. The steps for unlocking the cover 120 are the same as described above with respect to FIGS. 2–4. First, the gauge 132 is removed from the pipe 30. Next, a tool is used to rotate an actuator head a quarter turn to unlock the lock mechanism. The cover 120 may then be lifted off, providing a substantially open top as shown in FIG. 13. Now the interior cavity of the safe may be accessed to store or retrieve valuables.

Figure 14:
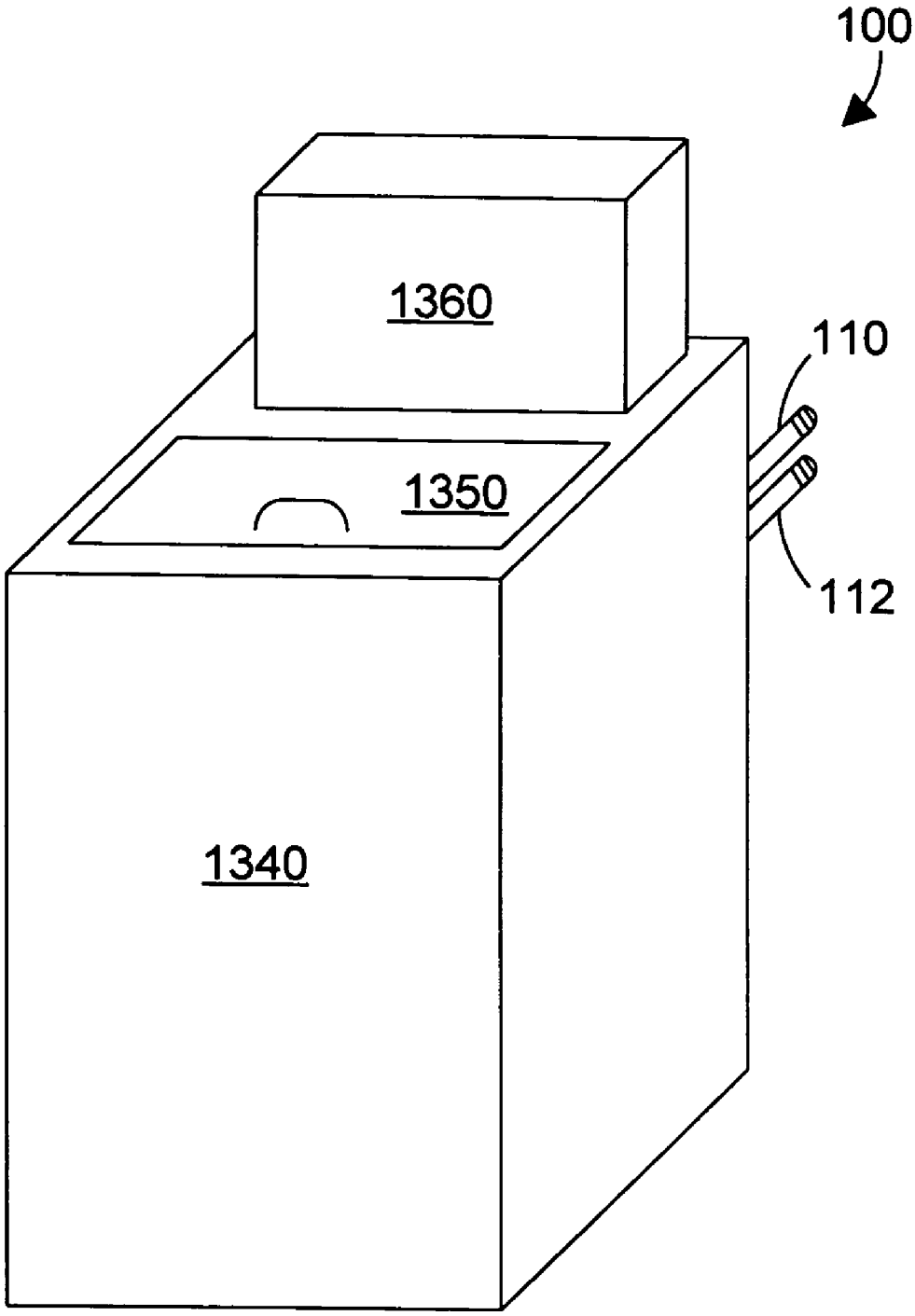
FIG. 14 is a front view of a water softener apparatus in accordance with the preferred embodiments.

Yet another suitable example of a water processing apparatus is a water softener. A safe 100 that has the external appearance of a cabinet-style water softener is shown in FIG. 14. The safe includes a lower cabinet that has a door 1350 that has the appearance of a door that is opened to add salt. A head portion 1360 provides the appearance of a control box that controls the function of the water softener, and may include a display and a keypad. A suitable lock mechanism can lock the door 1350 in place. Furthermore, there may be a second enclosure within the lower cabinet 1340 that is revealed once door 1350 is opened. This second enclosure could include any suitable locking mechanism. While the safe 100 in FIG. 13 is shown in the configuration of a cabinet-style water softener, other styles of water softeners that include two cylinders are equally within the scope of the preferred embodiments.

A safe 100 may be top-loading, as shown in FIGS. 1–5 and 11–13, or could be side-loading, as shown in FIGS. 7–10. Of course, any suitable interior configuration in the safe could be used, including a carousel for holding long guns, one of more shelves for holding pistols or ammo, etc. In the preferred embodiments, the safe includes at least one plumbing device that substantially conceals an actuator for the lock mechanism. A plumbing device as used herein means any pipe or other device that may be coupled to a plumbing fitting using any suitable connection mechanism including threads, solder joints, glued joints, press-fit joints, etc.

One advantage of the safe of the preferred embodiments is that one or more of the plumbing fittings that make the safe appear to be a water processing apparatus may be used to anchor the safe in place. For example, pipes 110 and 112 could pass through a wall surface (such as sheetrock) and may be anchored to a suitable device within the wall. The result is that safe 100 is anchored into place using pipes. Even if a thief were to discover the safe, the one or more lock mechanisms would make the safe very difficult to break into, and the anchors provided by the pipes 110 and 112 being anchored within a wall make the safe 100 very difficult to remove. In addition, the safe is preferably made of a heavy gauge metal, making the safe sufficiently heavy that it is difficult for one person to move. In addition, the safe may have a live wire running into the electrical box 150 to provide power to an electric dehumidifier. In this case, the thief would have to cut a live wire in order to transport the safe to a different location.

The safe of the preferred embodiments provides an excellent place to store valuables. The safe is disguised to look like a water processing apparatus, such as a water heater, water softener, or pressure tank. The safe includes a lock mechanism that requires a special tool to actuate the lock. The lock mechanism may be accessed by removing a plumbing device that substantially conceals the lock actuator. Once the lock mechanism is actuated to its unlocked position, access to the valuable storage cavity is allowed.

One advantage of the lock mechanism illustrated in the drawings is the head may have any suitable configuration. For example, let's assume a manufacturer of the safe could choose any of the following head configurations for the lock mechanism actuator head: ½ inch triangle head; 9/16 inch triangle head; ⅝ triangle head; ½ square head; 9/16 inch square head; ⅝ inch square head; ½ inch pentagon head; 9/16 pentagon head; ⅝ inch pentagon head; ½ inch hex head; 9/16 hex head; ⅝ hex head; ¼ inch hex socket; 5/16 inch hex socket; ⅜ inch hex socket; T30 Torx head; T40 Torx head; and T50 Torx head. With these eighteen different options, the manufacturer could install a selected one and ship with the unit the corresponding tool. It is highly unlikely that a thief would carry tools capable of actuating all versions of the lock mechanism, even if the thief discovers the safe. The specific corresponding tool that mates with the actuator head is required to open the safe. By providing numerous different options, a manufacturer of the safe can provide enhanced security by providing a tool that corresponds with the particular type of actuator head on the safe. Thus, even if a thief thought a home owner might have one of these types of safes, the thief would thus have to carry eighteen different tools to be guaranteed to be able to access all the different styles of actuators in the example given above. If the manufacturer closely guards the secret of the types of actuator heads used, it would be difficult for a thief to discover all the possible tools that might be required to open the safe. In addition, the actuator and corresponding tool may have a unique unconventional shape or configuration such that only the corresponding tool may be used to actuate the actuator. This provides enhanced security because a thief would likely not have the right tool to open the safe.

Other items may be added that enhance the disguise as a water processing apparatus. For example, in a configuration that resembles a gas water heater, a dummy gas valve could be included. In a water heater configuration, a pressure relief valve could be included. A label with a manufacturer name and serial number could be included. In addition, various warning labels regarding hot water or pressure could be added. In sum, anything that enhances the disguise of the safe as a water processing apparatus is within the scope of the preferred embodiments.

One skilled in the art will appreciate that many variations are possible within the scope of the present invention. Thus, while the invention has been particularly shown and described with reference to preferred embodiments thereof, it will be understood by those skilled in the art that these and other changes in form and details may be made therein without departing from the spirit and scope of the invention.

What is claimed is:

1. An apparatus comprising:

an enclosure that defines a dry valuable storage cavity and that has an external configuration that resembles a water processing apparatus that includes a first plumbing fitting that partially conceals an actuator and a second plumbing fitting removably coupled to the first plumbing fitting that completely conceals the actuator when coupled to the first plumbing fitting and that provides access to the actuator using a corresponding wrench when removed from the first plumbing fitting, wherein the actuator comprises a head portion that may be rotated using the corresponding wrench;

an opening in the enclosure that allows access to the dry valuable storage cavity;

a movable cover that substantially covers the opening in a first position and that substantially uncovers the opening in a second position; and a lock mechanism coupled to the actuator that locks the movable cover in the first position when the actuator is in a locked position, and that allows moving the movable cover from the first position to the second position when the actuator is in an unlocked position.

2. The apparatus of claim 1 wherein the water processing apparatus comprises a water heater.

3. The apparatus of claim 1 wherein the water processing apparatus comprises a water softener.

4. The apparatus of claim 1 wherein the water processing apparatus comprises a pressure tank.

5. An apparatus comprising:

(A) a first enclosure comprising:

a first opening to a first interior portion that defines a dry valuable storage cavity;

a first cover that substantially covers the first opening in a first position and that substantially uncovers the first opening in a second position;

a first lock mechanism coupled to the first cover that locks the first cover in the first position when the first lock mechanism is in a first state and that allows moving the first cover from the first position to the second position when the first lock mechanism is in a second state;

(B) a second enclosure that substantially encloses the first enclosure, the second enclosure comprising first and second plumbing fittings to provide the second enclosure with an external configuration that resembles a water processing apparatus, the second enclosure comprising:

a second opening to an interior portion of the second enclosure, the second opening providing access to the first opening of the first enclosure;

a second cover that substantially covers the second opening in a first position;

a second lock mechanism that locks the second cover in the first position, the second lock mechanism comprising an actuator for moving the second lock mechanism between a locked state and an unlocked state, wherein the actuator comprises a head portion that may be actuated using a corresponding wrench that rotates the head portion; and the first plumbing fitting in proximity to the actuator and partially concealing the actuator; and the second plumbing fitting removably coupled to the first plumbing fitting that completely conceals the actuator when coupled to the first plumbing fitting and that provides access to the actuator using the corresponding wrench when removed from the first plumbing fitting.

6. The apparatus of claim 5 wherein the water processing apparatus comprises a water heater.

7. The apparatus of claim 5 wherein the water processing apparatus comprises a water softener.

8. The apparatus of claim 5 wherein the water processing apparatus comprises a pressure tank.

* * * * *